US006143074A

United States Patent [19]

Komori

[11] Patent Number: 6,143,074

[45] Date of Patent: Nov. 7, 2000

[54] COATING DEVICE

[75] Inventor: Tatsuo Komori, Toride, Japan

[73] Assignee: Komori Corporation, Tokyo, Japan

[21] Appl. No.: 09/064,878

[22] Filed: Apr. 23, 1998

[30] Foreign Application Priority Data

Apr. 23, 1997 [JP] Japan ..... 9-105587

[51] Int. Cl.[7] ..... B05C 1/00; B41F 5/04; B41F 5/02; B05D 1/00

[52] U.S. Cl. ..... 118/209; 118/227; 101/220; 101/229; 427/209; 427/211

[58] Field of Search ..... 118/46, 209, 227, 118/263, DIG. 15; 101/220, 229, 230, 231; 427/209, 210, 211, 282

[56] References Cited

U.S. PATENT DOCUMENTS 4,664,949 5/1987 Greiner et al. .
4,836,129 6/1989 Dahlgren .
4,841,903 6/1989 Bird ..... 118/46
5,309,839 5/1994 Hartung et al. .
5,335,596 8/1994 DeMoore et al. .

FOREIGN PATENT DOCUMENTS

3941571 A1 6/1990 Germany .
4213024 A1 10/1993 Germany .
59-184655 10/1984 Japan .
986362 3/1965 United Kingdom .

*Primary Examiner*—Richard Crispino
*Assistant Examiner*—J. A. Lorengo

[57] ABSTRACT

There is disclosed a coating device which can apply varnish to both faces of paper in a simple constitution. The coating device is provided with a pressure drum 12 for receiving paper from a transfer drum 11 and holding the paper, a first varnish application device 13 for applying varnish to a surface of the paper held by the pressure drum 12 and a second varnish application device 15 which applies the varnish to a rubber blanket on a peripheral face of the pressure drum 12 on an upstream side of a position in which the pressure drum 12 receives the paper. At the same time when the pressure drum 12 receives the paper, the varnish can be applied to the rear face of the paper.

10 Claims, 4 Drawing Sheets

COATING DEVICE

BACKGROUND OF THE INVENTION

1. Field of the Invention

The present invention relates to a coating device for applying varnish over printed paper to prevent the paper from being made dirty and enhance an appearance of the paper.

2. Description of the Related Art

A diagrammatic construction of a conventional coating unit incorporated in a sheet rotary printer for applying varnish to printed paper to prevent the paper from being made dirty and enhance the appearance of the paper is shown in FIG. 6.

In FIG. 6, numeral 110 denotes a coating unit, 111 denotes a transfer drum, 112 denotes a pressure drum, 113 denotes a varnish application device, 113*a* denotes a varnish vessel, 113*b* denotes a main roller, 113*c* denotes an adjustment roller, 113*d* denotes an attachment roller, 113*e* denotes a rubber drum, and 114 denotes a drier.

In the coating unit 110, varnish in the varnish vessel 113*a* of the varnish application device 113 is supplied via the main roller 113*b*, the adjustment roller 113*c* and the attachment roller 113*d* to the rubber drum 113*e*. After the varnish is applied by the rubber drum 113*e* to a surface of paper which is transferred via the transfer drum 111 to the pressure drum 112, the paper is transferred via a paper discharge drum 103*a* to a paper discharge chain 103*b*. While the paper is conveyed, it is dried by the drier 114.

In some case, the varnish is applied not only to the printed surface but also to a rear face of the paper in order to enhance a waterproofness of the paper. However, in the conventional coating unit, the varnish can be applied only to one face of the paper. Therefore, when the varnish is applied to both faces of the paper, the paper is turned over after it is discharged. Then, the paper needs to be supplied again to the coating device for applying the varnish thereto. Efficiency is thus deteriorated.

To solve the problem, a construction is proposed in which there are provided two coating units between which a paper reversing mechanism is disposed, so that varnish can be applied to both faces of paper. In the construction however, since the number of units is increased, the printer is enlarged. It is difficult to ensure a space for installing the printer. Further, cost remarkably rises.

The problem arises in this manner not only in the coating unit incorporated in the sheet rotary printer for printing one face of paper but also in a coating unit for applying varnish to paper in general, e.g. in a coating unit incorporated in the sheet rotary printer for printing both faces of paper, or in a coating unit which is used independently without being incorporated in the printer.

SUMMARY OF THE INVENTION

Therefore, it is an object of the present invention to provide a coating device which can apply varnish to both faces of sheet object in a simple constitution.

To attain this and other objects, the invention provides a coating device which is provided with a printing drum for receiving a sheet object from a sheet-object conveying drum and holding the sheet object, a first varnish application means for applying varnish to the sheet object held by the printing drum, and a second varnish application means for applying the varnish to a face opposite to a face of the sheet object to which the varnish is applied by the first varnish application means.

In the coating device, the second varnish application means applies the varnish to the sheet object on an upstream side of a position in which the varnish is applied to the sheet object by the first varnish application means.

In the coating device, the second varnish application means applies the varnish to a peripheral face of the printing drum on an upstream side of a position in which the printing drum receives the sheet object.

In the coating device, the varnish applied to the peripheral face of the printing drum is applied to the sheet object by a pressure applied by the printing drum and sheet-object conveying drum.

In the coating device, the varnish applied to the peripheral face of the printing drum is applied to the sheet object by a pressure applied by the printing drum and the first varnish application means.

The coating device is further provided with a first drying means of drying the varnish applied on the sheet object by the first varnish application means, and a second drying means of drying the varnish applied on the sheet object by the second varnish application means.

The coating device is further provided with a prior drying means provided on an upstream side of the second drying means in a conveying direction of the sheet object for drying the varnish applied by the second varnish application means.

In the coating device, a tip end of a gripper of the printing drum can be embedded inwardly from an outer peripheral face.

In the coating device, a covering member is wound around the peripheral face of the printing drum.

In the coating device, a pattern is formed on a surface of the covering member.

In the coating device, at least one of said first varnish application means or the second varnish application means is plurally arranged, and types of the varnish of the plurality of the first varnish application means or the varnish of the plurality of the second varnish application means are different from one another.

DETAILED DESCRIPTION OF THE PREFERRED EMBODIMENTS

Figure 1:
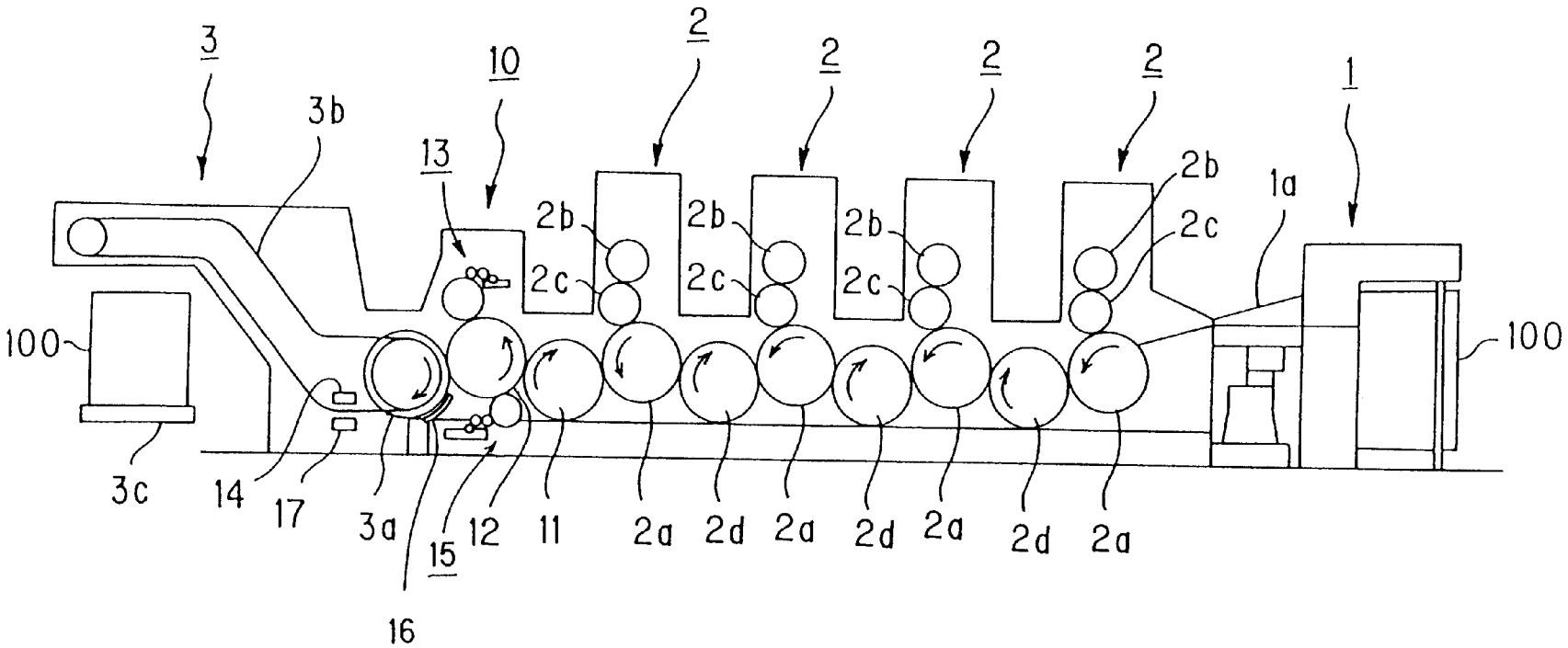
FIG. 1 is a diagrammatic view showing an entire construction of a coating device incorporated in a four-color sheet rotary printer according to a first embodiment of the invention.
Figure 2:
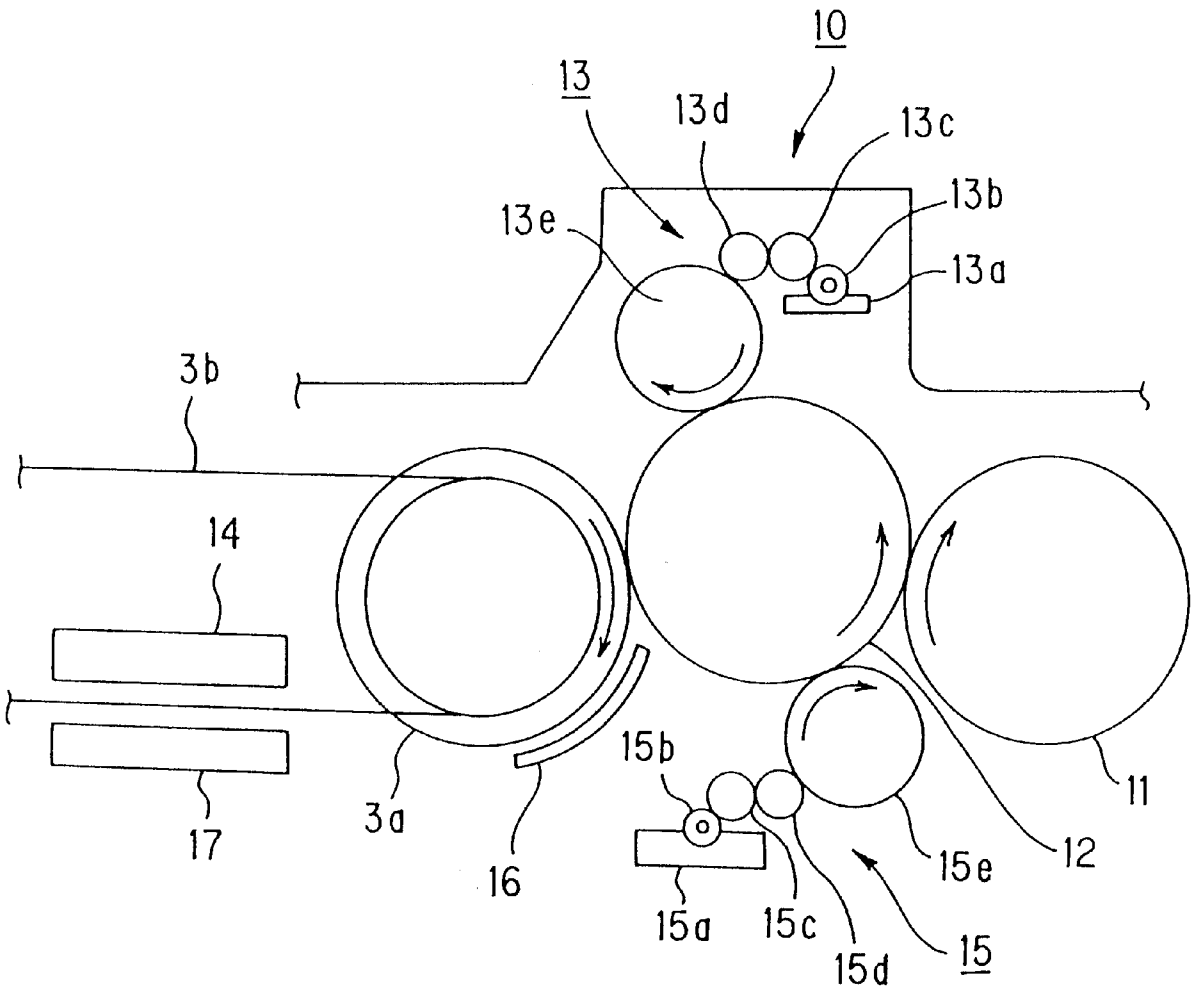
FIG. 2 is an enlarged view of a main portion of FIG. 1.
Figure 3:
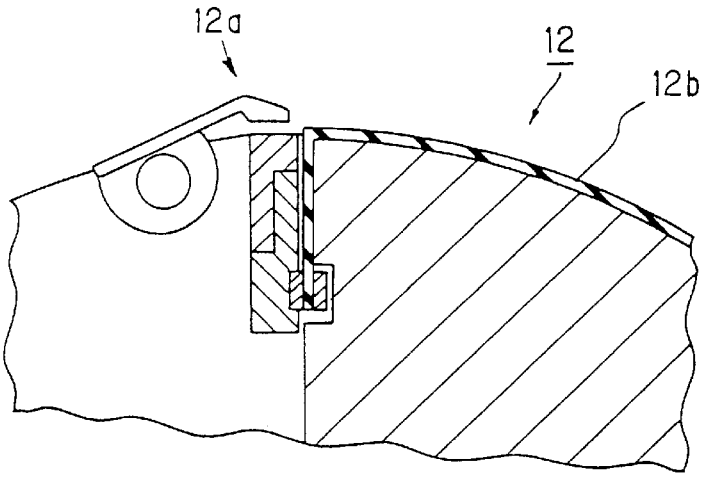
FIG. 3 is a partially enlarged sectional view of a pressure drum of FIG. 2.

A first embodiment of a coating device incorporated in a four-color sheet rotary printer will be described with reference to FIGS. 1 to 3. FIG. 1 is a diagrammatic view showing an entire constitution, FIG. 2 is an enlarged view showing a main portion of FIG. 1, and FIG. 3 is a partially enlarged sectional view of a pressure drum of FIG. 2.

In FIG. 1, numeral 1 denotes a paper supply unit, 2 denotes a printing unit, 3 denotes a paper discharge unit, and 10 denotes a coating unit as the coating device.

In the paper supply unit 1, sheets of paper 100 are laid on a paper tray. Each sheet of the paper 100 is drawn and supplied onto a plate 1*a* by a sucker device (not shown), and transferred by a swing device (not shown) to the printing unit 2.

The printing unit 2 is provided with a pressure drum 2*a* for receiving and holding the paper 100, a printing drum 2*b* with a printing plate attached to a peripheral face thereof, an ink device (not shown) for supplying ink to a printing surface of the printing plate of the printing drum 2*b*, a water supply device (not shown) for supplying water to the printing surface of the printing plate of the printing drum 2*b* and a rubber drum 2*c* for transferring an image formed on the printing surface of the printing plate of the printing drum 2*b* to the paper 100 on the pressure drum 2*a*. Four printing units 2 are arranged adjacent to one another in such a manner that four-color printing can be performed. Additionally, transfer drums 2*d* are disposed between the adjacent printing units 2 in such a manner that the paper 100 can be transferred therebetween.

In the paper discharge unit 3, the paper 100 from the previous process is received via a paper discharge drum 3*a* by a paper discharge chain 3*b*, conveyed, and dropped and laid onto a paper tray 3*c*.

The coating unit 10 interposed between the fourth printing unit 2 and the paper discharge unit 3 has a structure as shown in FIGS. 2 and 3.

In FIG. 2, numeral 11 denotes a transfer drum for conveying the paper, 12 denotes a printing or pressure drum, 13 denotes a first varnish application means or device, 14 denotes a first drying means or drier, 15 denotes a second varnish application means or device, 16 denotes a prior drying means or auxiliary drier, and 17 denotes a second drying means or drier.

The transfer drum 11 is provided adjacent to the pressure drum 2*a* of the fourth printing unit 2 in such a manner that the paper 100 can be received from the pressure drum 2*a*.

The pressure drum 12 is provided adjacent to the transfer drum 11, so that after the paper 100 is received from the transfer drum 11, the paper 100 can be transferred to the paper discharge chain 3*b* of the paper discharge unit 3. As shown in FIG. 3, a covering member or rubber blanket 12*b* is wound around an outer peripheral face of the pressure drum 12 in such a manner that a gripper 12*a* is not inhibited from holding the paper 100. In a winding structure of the blanket 12*b*, for example, a printing drum sheet holding device disclosed in the Japanese Utility Model Laid-open No. Hei 7-5735 or the like is applied.

The first varnish application device 13 is provided on a downstream side of a position in which the pressure drum 12 receives the paper 100 from the transfer drum 11. The first varnish application device 13 is provided with a varnish vessel 13*a* for storing varnish, a main roller 13*b* to be immersed in the varnish in the varnish vessel 13*a*, an adjustment roller 13*c* which abuts on the main roller 13*b*, an attachment roller 13*d* which abuts on the adjustment roller 13*c* and a rubber drum 13*e* which abuts on the attachment roller 13*d* and on the paper 100 held by the pressure drum 12. The varnish in the varnish vessel 13*a* is supplied via the main roller 13*b*, the adjustment roller 13*c* and the attachment roller 13*d* to the rubber drum 13*e*. The varnish can be applied by the rubber drum 13*e* to a surface of the paper 100 which is held by the pressure drum 12.

The first drier 14 is provided halfway above a conveyance path of the paper 100 by means of the paper discharge chain 3*b* of the paper discharge unit 3, so that the varnish applied on the surface of the paper 100 by the first varnish application device 13 is dried.

The second varnish application device 15 is provided on an upstream side of the position in which the pressure drum 12 receives the paper 100 from the transfer drum 11. The second varnish application device 15 is provided with a varnish vessel 15*a* for storing varnish, a main roller 15*b* to be immersed in the varnish in the varnish vessel 15*a*, an adjustment roller 15*c* which abuts on the main roller 15*b*, an attachment roller 15*d* which abuts on the adjustment roller 15*c*, and a rubber drum 15*e* which abuts on the attachment roller 15*d* and on the blanket 12*b* of the pressure drum 12. The varnish in the varnish vessel 15*a* is supplied via the main roller 15*b*, the adjustment roller 15*c* and the attachment roller 15*d* to the rubber drum 15*e*. The varnish can be applied by the rubber drum 15*e* to the blanket 12*b* of the pressure drum 12.

Specifically, the second varnish application device 15 applies the varnish to the blanket 12*b* of the pressure drum 12 before the pressure drum 12 holds the paper 100.

Therefore, when the transfer drum 11 transfers the paper 100 to the pressure drum 12, the varnish is applied via the pressure drum 12 to a rear face of the paper 100.

The auxiliary drier 16 is provided on a downstream side of a position in which the paper discharge drum 3*a* of the paper discharge unit 3 receives the paper 100 from the pressure drum 12. Therefore, the varnish applied on the rear face of the paper 100 by the second varnish application device 15 can be temporarily dried at the same time when the paper 100 starts to be conveyed. A friction or the like can be prevented from easily occurring in a conveyance guide at the time of conveyance.

The second drier 17 is provided halfway below the conveyance path of the paper 100 by means of the paper discharge chain 3*b* of the paper discharge unit 3. Therefore, the varnish applied on the rear face of the paper 100 by the second varnish application device 15 is securely dried.

Operation of the four-color sheet rotary printer with the coating unit 10 incorporated therein will be described below.

When the paper supply unit 1 transfers the paper 100 sheet by sheet to the pressure drum 2*a* of the first printing unit 2, the first printing unit 2 prints the surface of the paper 100 from the printing drum 2*b* via the rubber drum 2*c* and, subsequently, transfers the paper 100 via the transfer drum 2*d* to the second printing unit 2. In the same manner as aforementioned, the second printing unit 2 prints the surface of the paper 100, and transfers the paper 100 via the transfer drum 2*d* to the third printing unit 2. In the same manner as aforementioned, the third printing unit 2 prints the surface of the paper 100, and transfers the paper 100 via the transfer drum 2*d* to the fourth printing unit 2. In the same manner as aforementioned, the fourth printing unit 2 prints the surface of the paper 100, and transfers the paper 100 to the transfer drum 11 of the coating unit 10.

In the coating unit 10, the pressure drum 12 with the varnish applied beforehand onto the blanket 12*b* by the second varnish application device 15 receives the paper 100 from the transfer drum 11. Thereby, the varnish is applied to the rear face of the paper 100, while the varnish is applied by the first varnish application device 13 to the surface of the paper 100. Subsequently, the pressure drum 12 transfers the paper 100 via the paper discharge drum 3*a* of the paper discharge unit 3 to the paper discharge chain 3*b*. Then, at the same time that the paper 100 starts to be conveyed, the auxiliary drier 16 temporarily dries the varnish on the rear face of the paper 100. The paper 100 is prevented from being made dirty by the friction or the like in the conveyance guide. While the paper 100 is conveyed, the first drier 14 dries the varnish on the surface of the paper 100, and the second drier 17 dries the varnish on the rear face of the paper 100. Subsequently, the paper discharge chain 3*b* drops and lays the paper 100 onto the paper tray 3*c,* thereby completing the entire process.

Specifically, by applying the varnish to the pressure drum 12 beforehand, the varnish is applied to the rear face of the paper 100 when the paper 100 is transferred from the transfer drum 11.

Therefore, in the coating unit 10 described above, the varnish can be applied to both faces of the paper 100 in a simple constitution.

Consequently, in the four-color sheet rotary printer with the coating unit 10 incorporated therein, the increase of the number of constituent units can be suppressed. The printer can be prevented from being enlarged. The same installation space as for the conventional printer is sufficient. Further, cost can be inhibited from remarkably rising.

Also, when patterns such as grooves or the like are formed on a surface of the blanket 12*b* of the pressure drum 12 in the coating unit 10, the varnish can be applied only to necessary portions of the paper 100 (i. e. pattern coating is realized).

Figure 4:
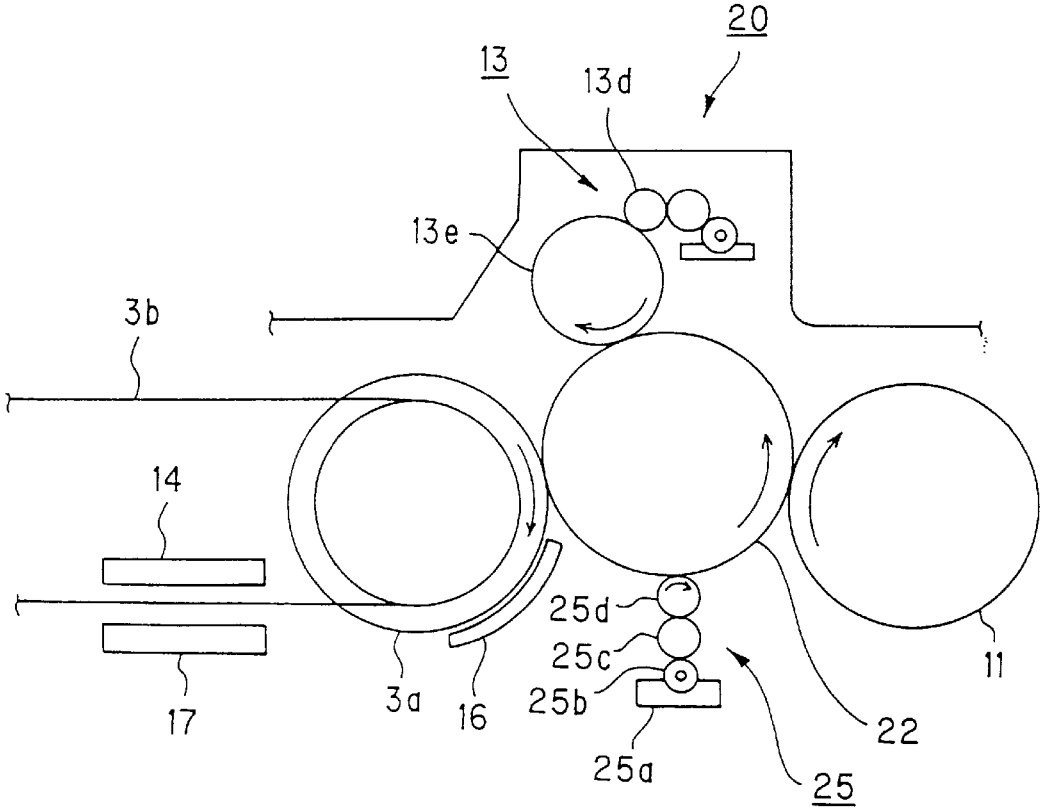
FIG. 4 is an enlarged view showing a main portion of the coating device incorporated in the four-color sheet rotary printer according to a second embodiment of the invention.
Figure 5:
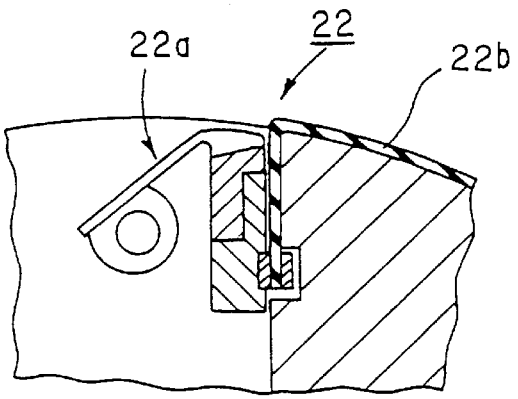
FIG. 5 is a partially enlarged sectional view of a pressure drum of FIG. 4.
Figure 6:
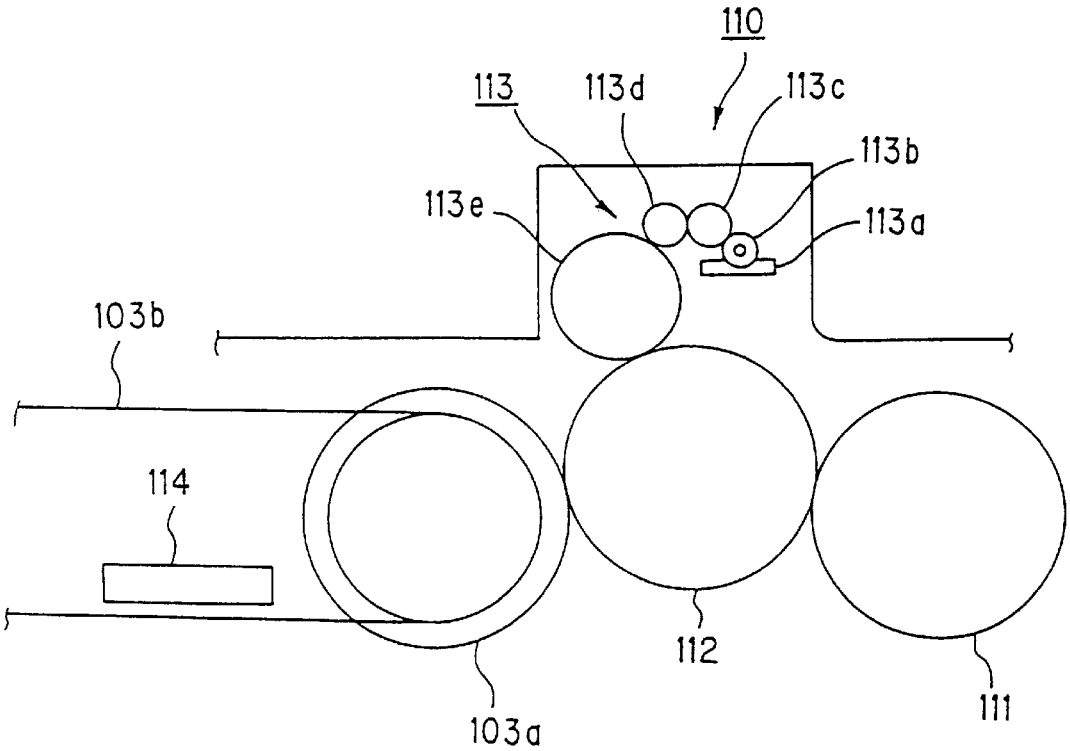
FIG. 6 CONVENTIONAL ART
FIG. 6 is a diagrammatic view showing a conventional coating unit incorporated in a sheet rotary printer.

A second embodiment of the coating device incorporated in the four-color sheet rotary printer will be described with reference to FIGS. 4 and 5. FIG. 4 is an enlarged view showing a main portion, and FIG. 5 is a partially enlarged sectional view of a pressure drum of FIG. 4. Additionally, the same portion as in the first embodiment is denoted by the same numerals as those which are used in the description of the first embodiment, and the description thereof is omitted.

In FIG. 4, numeral 20 denotes a coating device or unit, 22 denotes a printing or pressure drum, and 25 denotes a second varnish application means or device.

The second varnish application device 25 is provided on an upstream side of a position in which the pressure drum 22 receives the paper 100 from the transfer drum 11. The second varnish application device 25 is provided with a varnish vessel 25*a* for storing varnish, a main roller 25*b* to be immersed in the varnish in the varnish vessel 25*a,* an adjustment roller 25*c* which abuts on the main roller 25*b,* and an attachment roller 25*d* which abuts on the adjustment roller 25*c* and a blanket 22*b* of the pressure drum 22. The varnish in the varnish vessel 25*a* can be applied via the main roller 25*b,* the adjustment roller 25*c* and the attachment roller 25*d* to the blanket 22*b* of the pressure drum 22.

Specifically, in the first embodiment the varnish is applied by the rubber drum 15*e* to the blanket 12*b* of the pressure drum 12, while in the second embodiment the varnish is directly applied by the attachment roller 25*d* to the blanket 22*b* of the pressure drum 22 without using the rubber drum.

On the other hand, the pressure drum 22 has a construction substantially the same as the pressure drum 12 of the first embodiment. As shown in FIG. 5, however, a tip end of a gripper 22*a* is embedded inwardly so as not to protrude to the outside from an outer peripheral face.

Specifically, in the first embodiment, since the varnish is applied to the pressure drum 12 by using the rubber drum 15*e,* a tip end of the gripper 12*a* of the pressure drum 12 is not damaged even if it is protruded out of an outer peripheral face of the pressure drum 12. In the second embodiment, however, the varnish is applied to the pressure drum 22 directly by the attachment roller 25*d* with a metal surface. Therefore, by disposing the tip end of the gripper 22*a* inside the pressure drum 22 in such a manner that the tip end fails to protrude from the outer peripheral face of the pressure drum 22, the gripper 22*a* is prevented from being damaged.

In the coating unit 20, in the same manner as the first embodiment, the second varnish application device 25 applies the varnish in the varnish vessel 25*a* via the main roller 25*b,* the adjustment roller 25*c* and the attachment roller 25*d* to the blanket 22*b* of the pressure drum 22 before the pressure drum 22 holds the paper 100. Therefore, while the transfer drum 11 transfers the paper 100 to the pressure drum 22, the varnish can be applied via the pressure drum 22 to the rear face of the paper 100.

Consequently, in the second embodiment, the same effects as in the first embodiment can be obtained. Additionally, the number of components can be decreased and, therefore, cost can be reduced as compared with the first embodiment.

In the aforementioned embodiments, the rubber blankets 12*b* and 22*b* are wound around the pressure drums 12 and 22. Alternatively, for example, a covering member of resin, paper, aluminum or the like can be used. The covering member can be directly fixed to the pressure drum through baking or the like. Additionally, the covering member can be disposed on a peripheral face of the transfer drum (paper conveying drum), not on the peripheral face of the pressure drum.

In the embodiments, by applying the varnish to the pressure drum 12 or 22 with the second varnish application device 15 or 25, the varnish is applied to the rear face of the paper 100. Alternatively, the second varnish application device may be disposed in a vicinity of the transfer drum in such a manner that the varnish is applied to an outer face of the paper before it is transferred to the pressure drum, i.e., to the outer face of the paper held by the transfer drum. Thereby, the varnish can be applied to the face (rear face) opposite to the face (surface) to which the varnish is applied by the first varnish application device.

In the embodiments, the varnish applied to the pressure drum 12 or 22 with the second varnish application device 15 or 25 is applied to the rear face of the paper 100 by means of a pressure of the pressure drum 12 or 22 and the transfer drum 11. Alternatively, without using the pressure of the pressure drum 12 or 22 and the transfer drum 11, the varnish may be applied to the rear face of the paper 100 by a pressure of the pressure drum 12 or 22 and the rubber drum 13*e* of the first varnish application device 13 at the same time when the varnish is applied to the surface of the paper 100 by the first varnish application device 13.

In the embodiments, the paper 100 is transferred from the pressure drum 2*a* of the printing unit 2 via the transfer drum 11 of the coating unit 10 or 20 to the pressure drum 12 or 22. Alternatively, the transfer drum 11 may be omitted from the coating unit 10 or 20. In this case, the paper 100 can be directly transferred from the pressure drum 2*a* (serving as the paper conveying drum) of the printing unit 2 to the pressure drum 12 or 22 of the coating unit 10 or 20.

In the embodiments, one unit each of the varnish application devices 13, 15 and 25 is provided. Alternatively, two units each of the varnish application devices 13, 15 and 25 may be provided. In this case, one of plural units (e.g., two units) each of the varnish application devices 13, 15 and 25 handles a type of varnish different from a type of varnish handled by the other one (e. g., a UV varnish and a water varnish). Thereby, a highly glossy coating provided with folding endurance, crack resistance, flexibility, recyclability and the like is realized. On the other hand, when both the units handles the same type of varnish, a thick coating can be facilitated.

In the embodiments, the coating device incorporated in the sheet rotary printer for printing one face of paper has been described. The invention can be applied in the same manner to a coating device which is incorporated in a sheet rotary printer for printing both faces of paper, a coating device which is independently used without being incorporated in the printer and any other coating device that applies varnish to paper. Also in this case, the same effects as in the embodiments can be obtained.

In the coating device according to the invention, the first varnish application means applies varnish to one face of the paper held by the printing drum. Additionally, the second varnish application means applies the varnish to the other face of the paper before the first varnish application means applies varnish. Therefore, the varnish can be applied to both faces of the paper in a simple constitution.

In the aforementioned embodiments, the case of coating the paper has been described. The invention is not restricted to the embodiments. The invention can be applied to film constituted of resin or the like or any other sheet object having a sheet configuration in the same manner as the aforementioned embodiments.

What is claimed is:

1. A coating device which comprises:

a printing drum for receiving a sheet object from a sheet-object conveying drum and holding the sheet object;

a first varnish application means for applying varnish to said sheet object held by said printing drum; and a second varnish application means for applying the varnish to a face opposite to a face of said sheet object to which the varnish is applied by said first varnish application means;

wherein said second varnish application means applies the varnish to a peripheral face of said printing drum on an upstream side of a position in which said printing drum receives said sheet object.

2. The coating device according to claim 1 wherein said second varnish application means applies the varnish to said sheet object on an upstream side of a position in which the varnish is applied to said sheet object by said first varnish application means.

3. The coating device according to claim 1 wherein the varnish applied to the peripheral face of said printing drum is applied to said sheet object by a pressure applied by said printing drum and sheet-object conveying drum.

4. The coating device according to claim 1 wherein the varnish applied to the peripheral face of said printing drum is applied to said sheet object by a pressure applied by said printing drum and said first varnish application means.

5. The coating device according to claim 1 which comprises:

a first drying means of drying the varnish applied on said sheet object by said first varnish application means; and a second drying means of drying the varnish applied on said sheet object by said second varnish application means.

6. The coating device according to claim 5 which comprises a prior drying means provided on an upstream side of said second drying means in a conveying direction of said sheet object for drying the varnish applied by said second varnish application means.

7. The coating device according to claim 1 wherein a tip end of a gripper of said printing drum can be embedded inwardly from an outer peripheral face.

8. The coating device according to claim 1 wherein a covering member is wound around the peripheral face of said printing drum.

9. The coating device according to claim 8 wherein a pattern is formed on a surface of said covering member.

10. The coating device according to claim 1 wherein at least one of said first varnish application means or the second varnish application means is plurally arranged, and types of the varnish of the plurality of the first varnish application means or the varnish of the plurality of the second varnish application means are different from one another.

* * * * *